United States Patent [19]

Kuczynski et al.

[11] 4,379,278

[45] Apr. 5, 1983

[54] RESETABLE CIRCUIT BREAKER

[76] Inventors: Walter J. Kuczynski, 871 Pennsylvania Ave.; Robert A. Kuczynski, 1075 W. Chestnut St., both of Union, N.J. 07083

[21] Appl. No.: 203,596

[22] Filed: Nov. 3, 1980

[51] Int. Cl.[3] ..... H01H 61/04

[52] U.S. Cl. ..... 337/91; 337/85

[58] Field of Search ..... 337/91, 56, 368, 85, 337/68, 76, 109, 112, 113, 380, 373

[56] References Cited

U.S. PATENT DOCUMENTS 3,422,384 1/1969 Filchak et al. ..... 337/68

4,068,203 1/1978 Unger ..... 337/91

FOREIGN PATENT DOCUMENTS 903807 4/1962 United Kingdom ..... 337/85

*Primary Examiner*—Harold Broome

[57] ABSTRACT

A switch has staggered terminals for better breakdown performance. An integral housing is used for close tolerances. Coaxial alignment provides for smooth operation. A heat operated actuator is disposed in the housing to trip when the current exceeds a selected amount.

10 Claims, 27 Drawing Figures

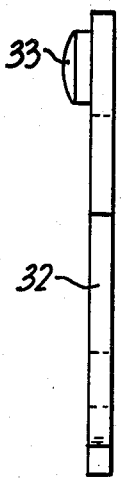
FIG. 8A
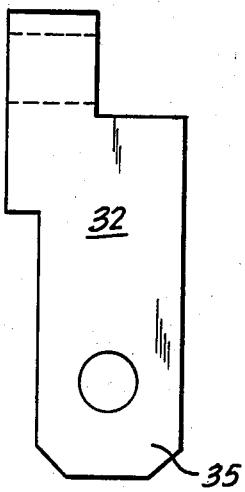
FIG. 8B
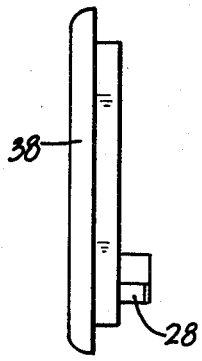
FIG. 9A
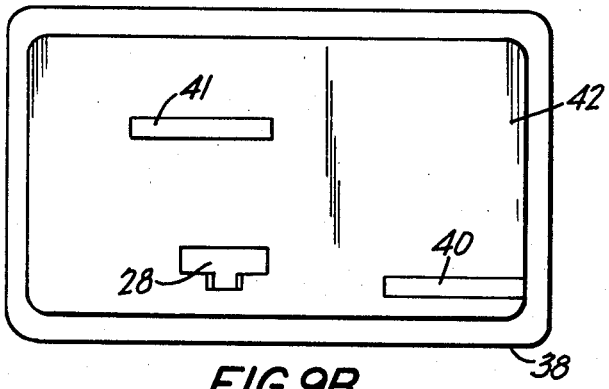
FIG. 9B
FIG. 9C
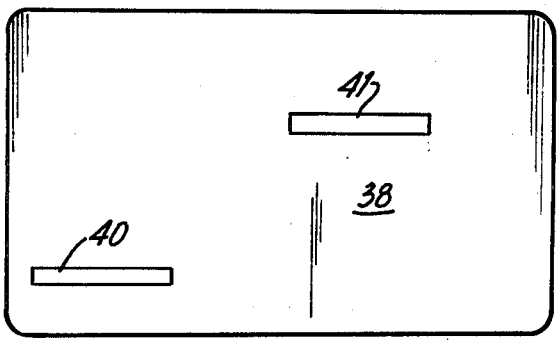

RESETABLE CIRCUIT BREAKER

BACKGROUND OF THE INVENTION

The present invention relates to circuit breaker switches and more particularly, to those that are resetable and small.

Prior art circuit breakers have numerous disadvantages. Many employ a "Taylor Blade" bimetallic actuator, such as shown in U.S. Pat. No. 2,503,008, which snaps due to increasing contact pressure and with appreciable amplitude. To prevent an inadvertent short circuit from occurring between the actuator when opening and the adjacent terminal, an insulating restraint is disposed therebetween. However, such restraint affects the calibration and stability of the switch, especially with high current overloads. Another problem is that a switch reset slide is spring actuated, but the spring and the slide do not have coinciding longitudinal axes. This, together with complex shapes or multiple parts, results in a structure that is easily jammed. Still another problem is that the prior art switches are enclosed in a multipiece housing, where the pieces are joined together during manufacture. Within the pieces are guide members with selected tolerances. The joining process results in excessively large tolerances since one piece is placed upon another, whereby tolerances accumulate. Yet another problem with the prior art is providing a low current circuit breaker. A resistance heater wire is used to augment the heat of the bimetallic actuator to obtain the desired lower ratings. However, it has been difficult to keep a constant spacing between the wire and the actuator, resulting in poor stability, i.e., varying open circuit trip currents.

It is therefore an object of the present invention to provide a switch with high stability.

It is another object to provide a switch that ensures smooth operation.

It is a further object to provide a switch that has accurate and close tolerances.

It is yet another object to provide a switch that can be safety miniaturized.

Still further objects include, economy, simplicity, ease of assembly, parts reduction, and quality assurance.

SUMMARY OF THE INVENTION

In brief, these and other objects are achieved by having staggered terminals with the actuator therebetween. This construction provides room sufficient for the actuator to react to severe overloads without requiring an insulating restraint. Further, it provides sufficient spacing between terminals and lugs to allow safe miniaturization. The switch components are mounted in an integrally formed housing and mounting section to provide close and accurate tolerances. A reset slide is coaxial with an actuating spring to insure smooth operation.

DESCRIPTION OF THE DRAWINGS

Other objects, features, and advantages will become apparent from the detailed description when taken in conjunction with the following drawings in which:

FIG. 6A is a top view of a reset slide, while

FIGS. 7A, B, C, and D are, respectively, a front, top, back, and side views of a cap for said slide, while

FIGS. 8A and B are side and top views, respectively, of a terminal;

FIGS. 9A, B and C are side, inside, and back views, respectively, of a back plate.

DETAILED DESCRIPTION

Figure 1A:
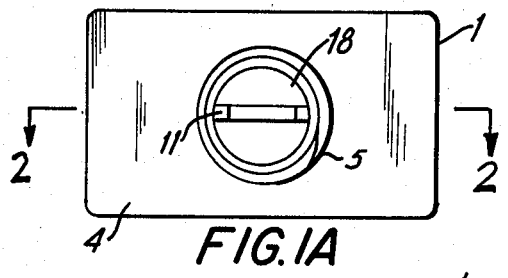
FIGS. 1A, B, and C are, respectively, front, top, and side views of an assembled switch in accordance with the invention.
Figure 10:
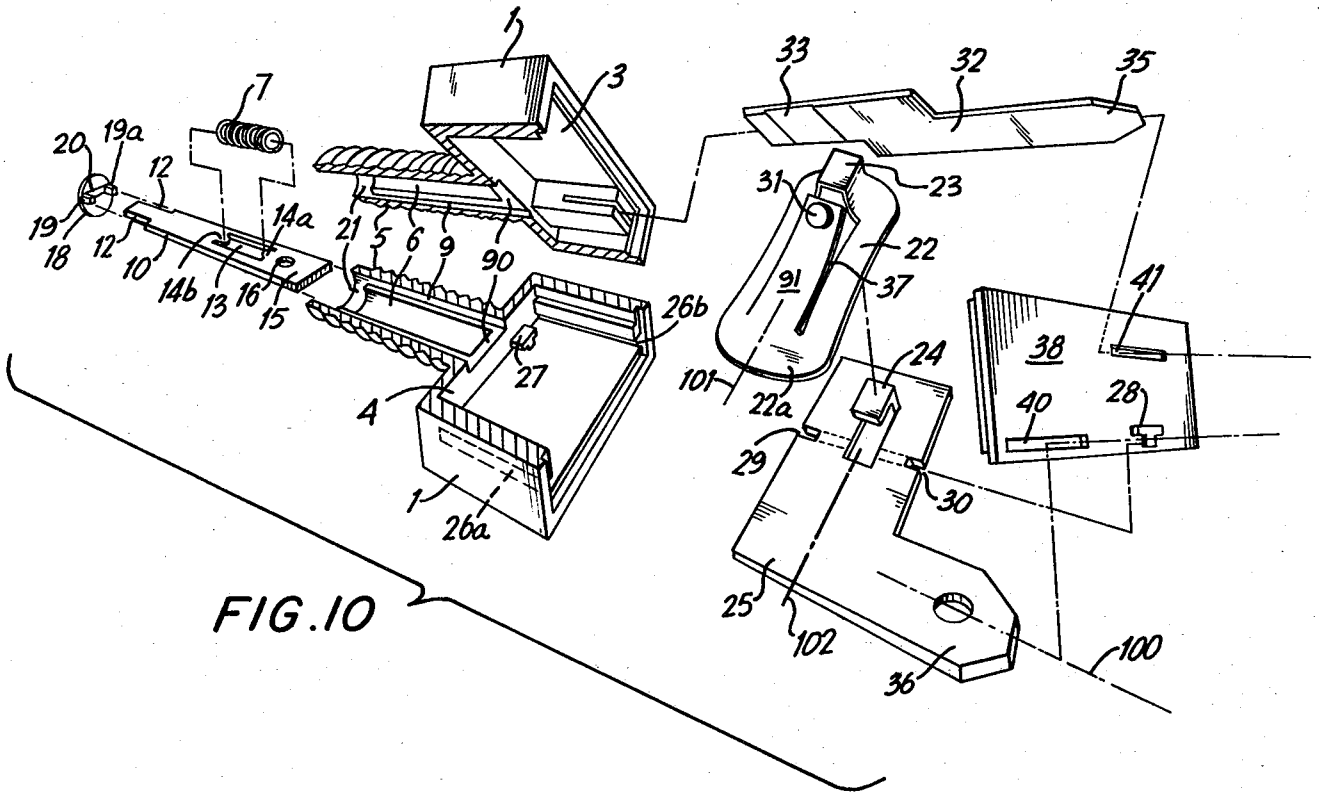
FIG. 10 is an exploded view of the invention.

Referring now to the drawing in detail and to FIG. 10 in particular, the snap action bimetallic circuit breaker has a rectangular housing 1 (see also FIG. 1A, B, and C) molded of electrically insulating plastic. Said housing 1 has a substantially hollow rectangular section 2 with opening 3 at one end and a wall 4 at the opposite end. Outwardly projecting from the geometric center of said wall 4 is a cylindrical threaded mounting member 5, providing the means of attachment to a panel or any apparatus (not shown) with which this invention is to be associated. A blind hole 6 aligned with the longitudinal axis of mounting member 5 terminates at a point equivalent to the surface of wall 4. The periphery of said hole 6 encloses actuator spring 7, but permits substantial movement of same. A slot 9, having a width and thickness sufficient to permit free movement of slide 10, starts at the open end of mounting member 5 and which has the same longitudinal axis, parallels the floor 8 of rectangular section 2 and penetrates wall 4 into the rectangular section 2 of housing 1.

Figure 6B:
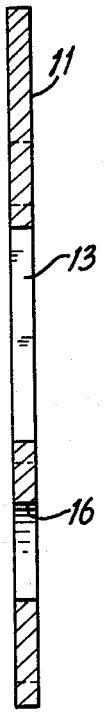
FIG. 6B is a cross-sectional view taken along line 6B—B of FIG. 6A.
Figure 6A:
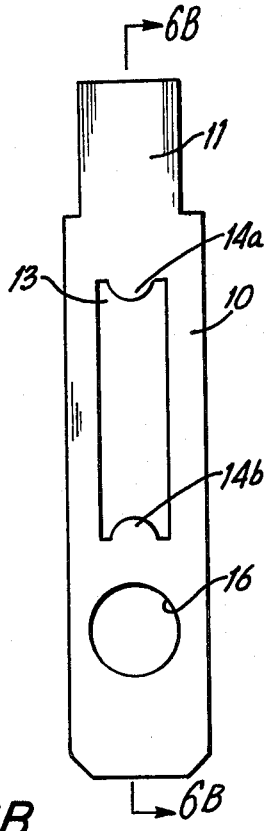
Figure 7A:
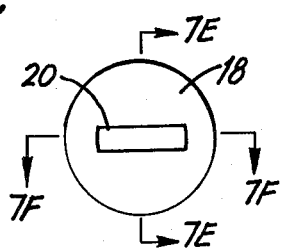
Figure 7B:
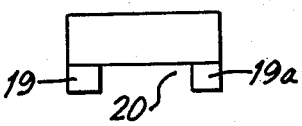
Figure 7C:
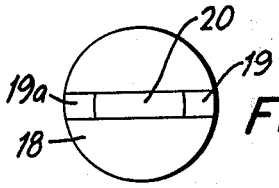
Figure 7D:
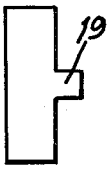
Figure 7E:
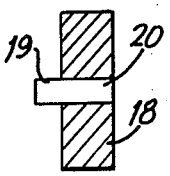
FIG. 7E is a cross-sectional view taken along line 7E—E of FIG. 7A.
Figure 7F:
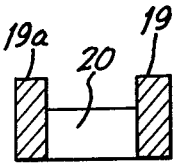
FIG. 7F is a cross-sectional view taken along line 7F—F of FIG. 7A.

The reset slide of phenolic type material 10 (FIGS. 6A and B), referred to as slide actuator hereafter, is blanked from flat bar stock to prevent rotation movement and to provide economy. The reduced width at one end provides the reset tab 11.

A generally rectangular shaped cut out 13 is disposed in slide 10 and has two inward projections 14*a* and 14*b*, to retain and align the actuating helical spring 7 which when placed in cut out 13 is under slight compression. The slide 10 with spring 7 in place is readily received into groove 9 of the mounting section 5 and through the rectangular hole 90 in wall 4 into the section 2 of the switch housing 1. Spring 7 being of a larger diameter than rectangular hole 90 provides a limit to further inward motion of slide 10.

The retaining end cap 18, shown in FIGS. 7A through F, provides two projections 19 and 19*a* separated by rectangular hole 20 effecting controlled alignment with housing 1. Said end cap 18 readily slides on said reset tab 11, while projections 19 and 19*a* slide into slot 9 until end cap 18 bottoms on counter-bore hole 21 of FIG. 10 to which it is ultrasonically welded.

Alternatively, it is conceivable that end cap 18 can readily be molded as a unit to the cylindrical mounting section 5 permitting entry of slide 10 with mounted actuator spring 7 through the switch housing opening 3 and a retaining member could be provided at wall 4.

Figure 2:
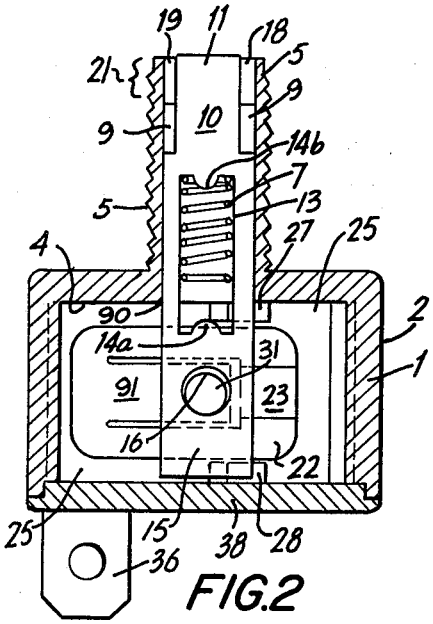
FIG. 2 is a top cross-sectional view taken along line 2—2 of FIG. 1A with the switch closed circuited.
Figure 3:
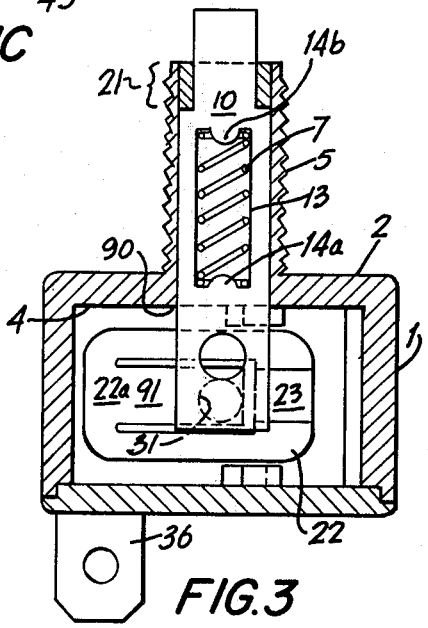
FIG. 3 is a top cross-sectional view taken along line 2—2 of FIG. 1A with the switch open circuited.
Figure 4A:
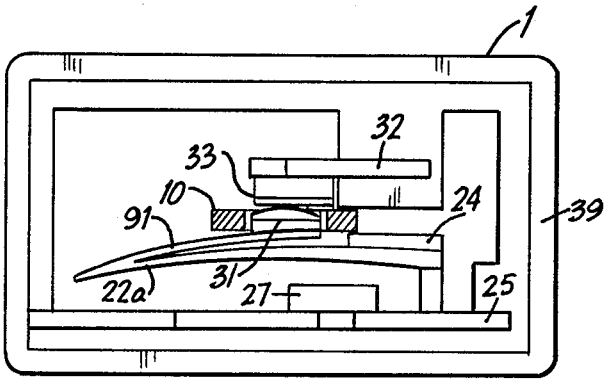
FIGS. 4A and 4B, are rear views of the switch, with the back plate removed, closed circuited, and open circuited, respectively.
Figure 4B:
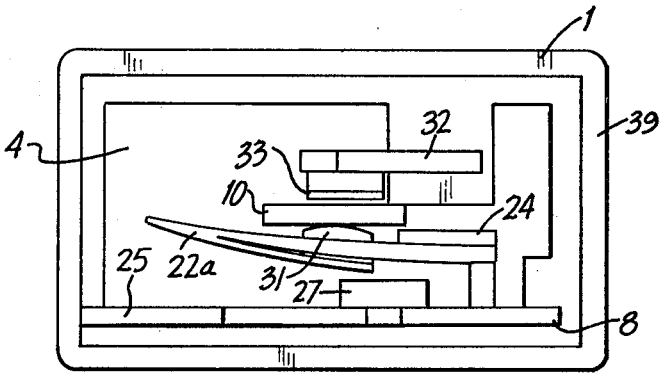
Figure 4C:
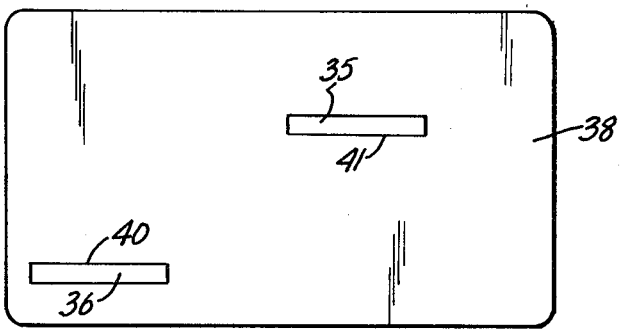
FIG. 4C shows the back plate secured.

The current responsive bimetal Taylor Blade actuator, FIGS. 2,3, and 4, hereafter referred to as the blade actuator 22, has by means of a U-shaped cutout a free center leg or tongue 91 to which at the free end a moving contact 31 is welded. The crimped section has a flat mounting area 23 by which it is welded to a sheared and formed mounting table 24 of a terminal 25 as shown in FIGS. 4,5, and 10. Said terminal 25 of electrically conductive material is basically rectangular in shape and has the extending terminal lug 36, which lug 36 is disposed at the opposite end to which the blade actuator 22 is mounted. The longitudinal axis 100 of lug 36 is perpendicular to the longitudinal axis of both the blade actuator 22 (101) and the axis 102 of rectangular shaped section of the terminal 25. This prositioning locates terminal lug 36 at the furthest point from center of the switch to obtain the desired separation between terminal lugs.

With blade actuator 22 attached, terminal 25 readily engages into slots 26*a* and 26*b* (see FIG. 10) and is positively located by the "T" projection 27 which projects from the switch wall 4 and is part of floor 8. The notch 29 in terminal 25 provides a slip fit locator and hold down, which is illustrated by FIGS. 4 and 10. FIG. 2 illustrates the terminal 25 with the attached blade 38 and its "T" projection 28 completing the entrapment of said terminal 25. Indicated in this drawing is the position whereby moving contact 31 protrudes through hole 16 of the insulator segment 15 of slide 10 and whereby contact is made with the stationary contact 33 shown in FIG. 4A.

Reset tab 11 is designed tamperproof by being encased in the retaining end cap 19 when the circuit is closed (see FIG. 2). The actuating helical spring 7 is under compression at this time. Normally, the center leg 91 of the blade actuator 22 presses the moving contact 31 against the stationary contact 33 (see FIG. 4A) by a predetermined amount. When an overload occurs, blade 22, particularly tail 22*a*, bends enough to buckle over the switch center resulting instantaneous displacement of the center leg 91 clearing movable contact 31 from the entrapment hole 16 permitting the compressed actuating spring 7 to activate extending the reset tab 11 beyond the retaining end cap 19 as shown in FIG. 3 indicating a tripped condition. Concurrently, insulator segment 15 moves between said contacts 31 and 33 as shown in FIG. 4B affecting an open circuit condition even after the blade actuator 22 has cooled sufficiently to snap to the closed position. The switch remains in this state until the tab 11 is depressed to close the circuit (see FIG. 2).

Figure 1B:
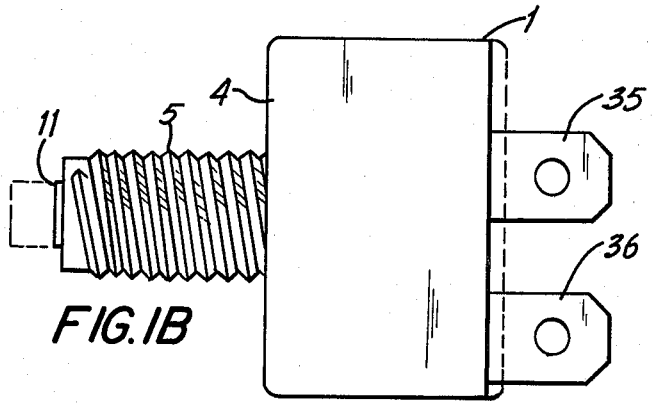
Figure 1C:
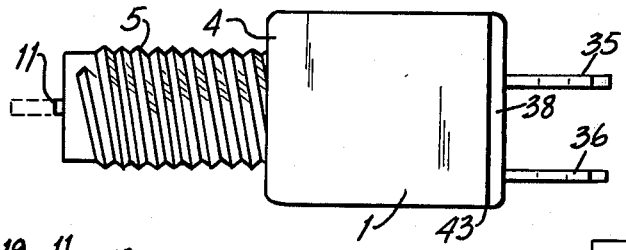

Basically having an offset rectangular shape, terminal 32, FIGS. 8A and B, provides for the positioning of stationary contact 33, while permitting unrestricted movement of the free end of blade actuator 22 on overload. Said terminal 32 in its entirety is parallel to the lug projection 36 of terminal 25 providing maximum separation in two planes (see FIG. 1). Provision is made for use of inlay (not shown) as well as contact button, or tape for the stationary contact 33 which is part of terminal 32 as shown in FIGS. 4 and 8.

Although terminals 25 and 32 have been defined as having terminal lugs 36 and 35 extending through the rear of back plate 38 (see FIG. 1 and 10), said lugs may be designed to project from the side wall 39 of the housing with modification of terminals 35 and 32, and by removal of lug receiving slots 40 and 41 of back plate 38 and providing said slots in housing 1 through the side walls. Thus it can be seen that the basic design can be readily modified to permit said lugs to extend from said housing as may be required and or if necessity dictates.

Back plate 38 of FIGS. 9A, B, and C is made of the same electrically insulating material as the housing 1 and provides slots 40 and 41 through which terminal lugs 36 and 35 slide. Integral "T" projection 28 on the inner surface 42 is readily accepted into notch 30 of terminal 25 which with preferably ultrasonic welding attachment at opening 3 completes the encasement of the switch.

Figure 5B:
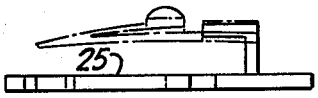
FIGS. 5A, B, and C are top and two side views, respectively, of a terminal without a heater.
FIGS. 5D and E are a top and a side view, respectively, of a modified terminal with a heater.
Figure 5E:
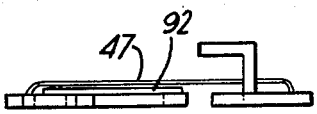
Figure 5A:
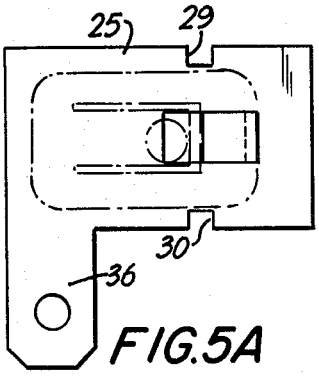
Figure 5C:
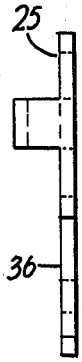
Figure 5D:
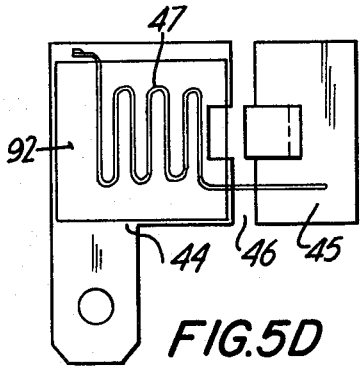

The present invention is readily adaptable to provide for fractional and other low ratings which require heaters to augment the heating effect of the bimetal actuator 22. To do this, notches 29 and 30 of FIG. 5A are extended to effect separation 46 of FIG. 5D. The wire heater 47 in a preferred serpentine configuration is attached by weldment of one end to terminal segment 44 and its other end to segment 45 on which blade actuator 22 has been attached. A very thin inexpensive rectangular wafer of mica 90 is provided between the heater 47 and terminal segment 44. Wafer 47 guards against short circuiting as well as provides better reflection of the heat of the heater 47 to the blade actuator, which effect is desired. The "T" projections 27 and 28 provide the separation and hold down of terminal segments 44 and 45 and thereby provide the interchangeability of the terminal of FIG. 5D and FIG. 5E.

It will be appreciated that many other embodiments are possible without department from the spirit and scope of the invention.

What is claimed is:

1. A manually resettable switch comprising first and second terminals, said second terminal having a contact, a moveable actuator affixed to said first terminal and having a contact adapted to move into and out of engagement with said second terminal contact, said actuator having a tail and being between said terminals, said second terminal not extending directly above said tail, and an insulating slide biased to be disposed between said contacts when said contacts are not mutually engaged, said slide and said tail having mutual perpendicular longitudinal axes, thereby providing clearance for said actuator tail whereby said actuator is free to move over a relatively large area.

2. A switch as claimed in claim 1, wherein said terminals are in a staggered relationship which relationship defines a free space above said first terminal and to the side of said second terminal, said actuator tail disposed in said free space.

3. A switch as claimed in claim 1, wherein said first terminal comprises a lug; said first terminal, said lug, and said actuator all comprising a longitudinal direction, said lug longitudinal direction being perpendicular to said longitudinal direction of said actuator and first terminal longitudinal directions.

4. A switch comprising first and second terminals, an actuator mounted on said first terminal and having a contact for engaging said second terminal, a slide for movement between said contact and said second terminal and having a reset tab, a retainer slot, and a longitudinal axis, and a spring mounted within said slot and having a longitudinal axis coincident with said slide longitudinal axis and said contact when said contact engages said second terminal.

5. A switch as claimed in claim 4, wherein said slide has a hole to permit said contact to project therethrough to engage said second terminal.

6. A switch as claimed in claim 4, further comprising a housing having a mounting first section containing said spring and a portion of said slide, and a second section containing the remaining portion of said slide and said terminals.

7. A switch comprising an integrally formed housing having integrally formed guiding members therein, a back side, and a center wall, and a pair of terminals disposed in said guiding members on one side of said center wall, one of said terminals having a first contact, a moveable actuator affixed to the remaining terminal and having a second contact for engaging said first contact, and a reset slide disposed in said guiding members on another side of said center wall, said center wall being a limit for said terminals and said slide, whereby close tolerances of said terminals and slide with respect to each other are achieved.

8. A switch comprising first and second terminals, a heat operated actuator coupled to said first terminal and adapted to normally engage said second terminal and to disengage when heated, said first terminal being split into two sections, an insulator being disposed adjacent said first terminal, and an electrical resistance heater coupled across said sections adjacent said insulator and proximate said actuator at an accurate selected distance therefrom and a housing, said housing having a means for locating, separating and securing said sections.

9. A switch as claimed in claim 8, wherein said first terminal comprises an integrally formed mounting table, said actuator being welded thereon.

10. A switch as claimed in claim 7, further comprising a back plate having a guide and a pair of slots for further securing said terminals, said back plate being disposed in said back side.

* * * * *